US011367549B2

(12) United States Patent
Zachman

(10) Patent No.: US 11,367,549 B2
(45) Date of Patent: Jun. 21, 2022

(54) RELEASABLE MAGNETIC COUPLER

(71) Applicant: DJ SQUARED, INC., Foutaintown, IN (US)

(72) Inventor: John P. H. Zachman, Indianapolis, IN (US)

(73) Assignee: DJ Squared, Inc., Fountaintown, IN (US)

( * ) Notice: Subject to any disclaimer, the term of this patent is extended or adjusted under 35 U.S.C. 154(b) by 50 days.

(21) Appl. No.: 16/801,378

(22) Filed: Feb. 26, 2020

(65) Prior Publication Data

US 2020/0273614 A1 Aug. 27, 2020

Related U.S. Application Data

(60) Provisional application No. 62/811,280, filed on Feb. 27, 2019.

(51) Int. Cl.
*H01F 7/02* (2006.01)
*H01F 7/04* (2006.01)

(52) U.S. Cl.
CPC ..... *H01F 7/0231* (2013.01); *H01F 7/04* (2013.01)

(58) Field of Classification Search
CPC ..... H01F 7/0231; H01F 7/04
USPC ..... 335/285–306
See application file for complete search history.

(56) References Cited

U.S. PATENT DOCUMENTS

| | | | | |
|---|---|---|---|---|
| 2,760,809 | A * | 8/1956 | Mallin | H01F 7/0257 294/65.5 |
| 3,079,191 | A * | 2/1963 | Engelsted | H01F 7/04 294/65.5 |
| 4,102,053 | A * | 7/1978 | Colwell | F41G 1/06 335/285 |
| 6,434,894 | B2 * | 8/2002 | Reymann | B28B 7/0017 249/139 |
| 7,952,455 | B2 * | 5/2011 | Crawshaw | H01F 7/04 335/219 |
| 8,702,079 | B2 * | 4/2014 | Sladojevic | B28B 7/002 269/8 |
| 9,583,245 | B2 * | 2/2017 | Hong | H01F 7/0221 |
| 9,818,522 | B2 * | 11/2017 | Kocijan | B66C 1/04 |
| 2020/0219641 | A1 * | 7/2020 | Nellessen | B25B 11/002 |

* cited by examiner

*Primary Examiner* — Alexander Talpalatski
(74) *Attorney, Agent, or Firm* — Taft Stettinius & Hollister LLP

(57) ABSTRACT

A magnetic coupler having a housing defining a coupler plane, a magnet assembly positioned at least partially within the housing, the magnet assembly being movable relative to the coupler plane, and a release assembly coupled to the magnet assembly to selectively reposition the magnet assembly relative to the coupler plane based on the angular orientation of the release assembly.

16 Claims, 5 Drawing Sheets

RELEASABLE MAGNETIC COUPLER

CROSS-REFERENCE TO RELATED APPLICATION

The present application claims the benefit of U.S. Provisional Application No. 62/811,280 filed on Feb. 27, 2019, the contents of which are hereby incorporated herein in entirety.

TECHNICAL FIELD

The present teachings are related to a magnetic coupler, and more particularly to a magnetic coupler that is releasable by rotating a cap.

BACKGROUND

Concrete is a building material that has been used to construct a variety of structures. Concrete has several ingredients that are mixed together and placed in a flowable state. The flowable concrete is then given its final shape by pouring it into a "form" that serves the same primary purpose as a mold, insofar as the cured concrete has a shape that mimics the shape of the form.

Typically, forms can be as simple as a rectangular box that is formed to have the proper dimensions of the desired final product. Alternately, the form can comprise a tall steel walled member when one is pouring a concrete wall. As the concrete form serves the same basic purpose as a mold, it will be appreciated that the size and shape of the form will be governed largely by the size and shape of the end product structure being created.

Although most concrete structures are formed in the place where they will ultimately reside, a large number of concrete structures are formed in "pre-cast" concrete products, at a place remote from the final resting spot of the product. The same process forming concrete structures is generally employed in the creation of a pre-cast concrete structures. However, pre-cast concrete structures are typically formed in metal forms that are capable of being re-used quite often to create a variety of concrete structures. Metal forms are usually employed because they have superior release capabilities and durability.

In production, a pre-cast concrete mold or form is usually formed of steel that is placed onto a steel floor or stage surface. Concrete is then poured into the form on the floor to an appropriate depth and allowed to harden or cure. After the hardening of the concrete occurs, the pre-cast concrete structure is removed from the form and shipped to the place where it is to be installed. The slab forms are often magnetically held in position via magnetically coupling them to the steel table, for example, using magnetic coupling devices such as a loaf, bar, or button magnet.

The magnetic couplers often utilize a permanent magnet assembly to couple the coupler assembly to an adjacent surface by positioning the permanent magnet assembly directly adjacent to the ferromagnetic material on the adjacent surface. Once positioned as described, the permanent magnet assembly is drawn to the adjacent surface to thereby couple the magnetic coupler to the adjacent surface with the magnetic field of the permanent magnet or magnets attracting the ferromagnetic material of the adjacent surface.

Removing the permanent magnet assembly from the adjacent surface often requires a user to apply a separation force on the permanent magnet away from the adjacent surface to thereby separate the permanent magnet from the ferromagnetic material. Often, this is done utilizing a pry bar to pull a tab coupled to the permanent magnet assembly. In order for the pry bar to apply a sufficient force on the permanent magnet assembly to separate it from the adjacent surface, the pry bar often has a substantial length to provide sufficient leverage to force the tab and permanent magnet away from the adjacent surface. Once the permanent magnet assembly is separated from the adjacent surface a sufficient distance, the magnetic field acting on the adjacent ferromagnetic material will be insufficient to couple the magnetic coupler thereto and the magnetic coupler and the form portion may be easily removed or otherwise repositioned.

There is a need for a magnetic coupler that is more easily releasable from a ferromagnetic material.

SUMMARY

One embodiment is a magnetic coupler that has a housing defining a coupler plane, a magnet assembly positioned at least partially within the housing, the magnet assembly being movable relative to the coupler plane, and a release assembly coupled to the magnet assembly to selectively reposition the magnet assembly relative to the coupler plane based on the angular orientation of the release assembly.

In one example of this embodiment, the release assembly has a bushing that is rotatable about a rotation axis relative to the housing. One aspect of this example includes a cam collar coupled to the housing about the rotation axis, the cam collar defining a helix segment. Another aspect has a magnet shaft positioned along the rotation axis and coupled to the magnet assembly on one end and extending through a portion of the housing, the magnet shaft further defining a radially expanded head. In yet another aspect the expanded head is positioned at least partially within the bushing. Another aspect has a pin coupled to the bushing and positioned along the helix segment of the cam collar, wherein rotating the bushing causes the pin to move along the helix segment to thereby reposition the location of the magnet assembly relative to the coupler plane. This aspect also has a hex cap positioned at least partially around the bushing and the cam collar, the hex cap being coupled to the pin, wherein rotation of the hex cap also rotates the bushing with the pin. In one part of this aspect the hex cap has a first angular position and a second angular position, wherein in the first angular position the pin is located along a portion of the helix segment to position the magnet assembly adjacent to the coupler plane and in the second angular position the pin is locate along a portion of the helix segment to position the magnet assembly away from the coupler plane.

Another embodiment is a magnetic coupler assembly that has a housing defining a coupler plane, a magnet assembly positioned at least partially within the housing, the magnet assembly being movable relative to the coupler plane, and a release assembly. The release assembly has a bushing that is rotatable about a rotation axis relative to the housing, the bushing defining a radial lip, a cam collar coupled to the housing about the rotation axis, the cam collar defining a helix segment, a magnet shaft defined along the rotation axis and coupled to the magnet assembly on one end and extending through a portion of the housing and defining an expanded head on the other end, and a pin coupled to the bushing and positioned along the helix segment of the cam collar. Wherein the radial lip of the bushing is positioned at least partially between the expanded head of the magnet shaft and the housing and rotating the pin about the rotation axis repositions the bushing, magnet shaft, and magnet axially along the rotation axis relative to the coupler plane between an adjacent position and a spaced position.

One example of this embodiment includes a hex cap positioned at least partially around the bushing and the cam collar, the hex cap being coupled to the pin, wherein rotation of the hex cap also rotates the bushing with the pin. In one aspect of this example, the hex cap has a first angular position and a second angular position, wherein in the first angular position the pin is located along a breakaway section of the helix segment to position the magnet assembly in the adjacent position relative to the coupler plane and in the second angular position the pin is locate along transition section of the helix segment to position the magnet assembly in the spaced position relative to the coupler plane.

In another example, the housing is coupled to a form wall.

In yet another example of this embodiment, the magnet assembly has a permanent magnet.

In another example, in the spaced position the magnet assembly is sufficiently spaced from the coupler plane within the housing so any magnetic force of the magnet assembly does not substantially attract ferromagnetic material positioned along the coupler plane.

In yet another example, in the spaced position the magnetic coupler is not substantially magnetically coupled to a ferromagnetic material along the coupler plane and in the adjacent position the magnetic coupler is magnetically coupled to ferromagnetic material along the coupler plane.

In another example of this embodiment, the housing defines a cavity with an opening along the coupler plane, wherein in the spaced position the magnet assembly moves away from the coupler plane into the cavity. In one aspect of this example, the breakaway section is defined at a first angle relative to the coupler plane and the transition section is defined a second angle relative to the coupler plane, the first angle being different from the second angle. In part of this aspect, the first angle is less than the second angle.

Yet another embodiment is a system for coupling a form to a base that includes a form element, and a magnetic coupler assembly coupled to the form element. The magnetic coupler assembly has a housing defining a coupler plane, a magnet assembly positioned at least partially within the housing, the magnet assembly being movable relative to the coupler plane, and a release assembly. The release assembly has a bushing that is rotatable about a rotation axis relative to the housing, the bushing defining a radial lip, a cam collar coupled to the housing about the rotation axis, the cam collar defining a helix segment, a magnet shaft defined along the rotation axis and coupled to the magnet assembly on one end and extending through a portion of the housing and defining an expanded head on the other end, and a pin coupled to the bushing and positioned along the helix segment of the cam collar. Wherein the radial lip of the bushing is positioned at least partially between the expanded head of the magnet shaft and the housing and rotating the pin about the rotation axis reposition the bushing, magnet shaft, and magnet axially along the rotation axis relative to the coupler plane between an adjacent position and a spaced position.

In one example of this embodiment, when the magnet is in the adjacent position, the form wall is magnetically coupled to an underlying form table to substantially restrict the form wall from moving and when the magnet assembly is in the spaced position the form wall is not substantially magnetically coupled to the underlying form table and the form wall may be moved relative to the form table.

DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The above-mentioned aspects of the present application and the manner of obtaining them will become more apparent and the teachings of the present application itself will be better understood by reference to the following description of the embodiments of the present application taken in conjunction with the accompanying drawings.

Figure 1:
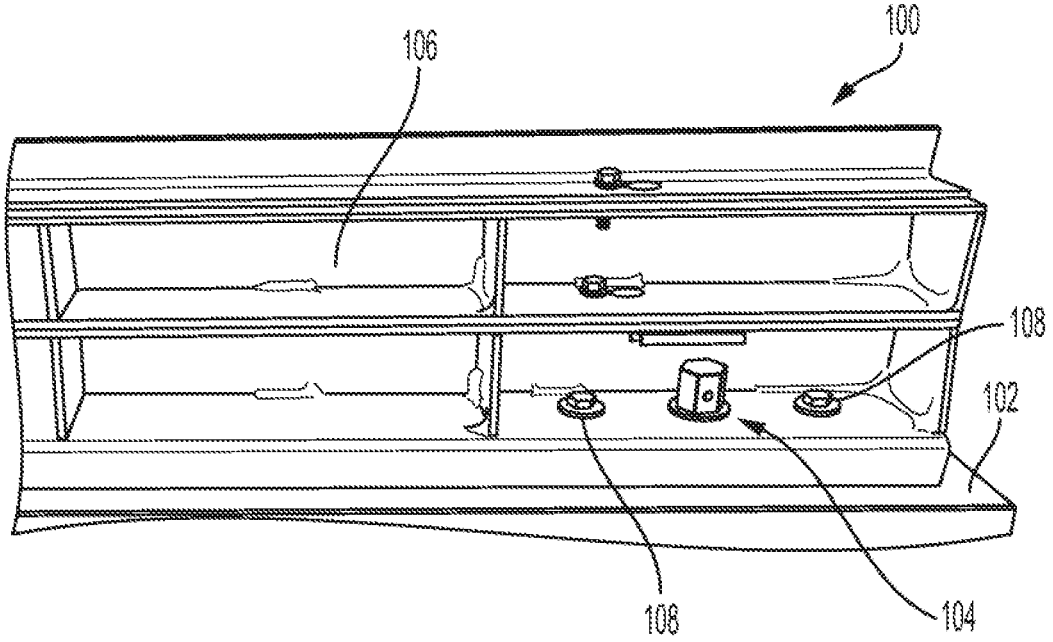
FIG. 1 is an elevated perspective view of a form assembly.

FIG. 1 illustrates a form assembly 100 coupled to a base 102 with a magnetic coupler assembly 104 partially hidden. The form assembly 100 may have one or more form element 106 coupled to one another to provide barrier for a form substance, such as cement or the like. The form elements 106 may be intended to define exterior surfaces of concrete walls for example, or other concrete products. Regardless of the intended final product of the form assembly 100, the form assembly 100 often needs repositioned or removed from the base 102 after the final product has cured.

In one aspect of this disclosure, the magnetic coupler assembly 104 may selectively couple the form assembly 100 to the base 102. In one non-exclusive example, the base 102 is made of a ferromagnetic material and the magnetic coupler assembly 104 has one or more magnet 402 (see FIGS. 4 and 5) positioned therein. The magnetic coupler assembly 104 may be selectively magnetically coupled to the base 102 to hold the form assembly 100 in a desired orientation.

The term "magnetically coupled" refers to the magnet 402 being positioned adjacent to the surface of the base 102 to thereby exert a magnet force on the base 102 and temporarily couple the form assembly 100 to the base 102 with the magnetic coupler assembly 104. The magnet force between the magnetic coupler assembly 104 and the base 102 may be sufficiently strong to substantially restrict the form assembly 100 from moving relative to the base 102 when magnetically coupled thereto.

The particular strength of the magnet 402 used in the magnetic coupler assembly 104 may depend on the type of form assembly 100. More specifically, if the form assembly 100 is going to experience substantial deflection force from the form substance when poured therein, a magnet 402 with a very strong magnetic force may be utilized. Alternatively, if the form substance is not likely to exert a substantial force on the form assembly 100 prior to curing, a magnet assembly or magnet 402 with a weaker magnetic force may be used. Accordingly, the particular strength of the magnet 402 in the magnetic coupler 104 may be different for magnetic couplers for different form assembly applications.

In one non-exclusive embodiment, the magnet 402 may withstand a separation force of about one ton and a sheer force of about seven-hundred pounds before the magnetic coupler assembly 104 will move relative to the base 102. However, in other embodiments considered herein the magnet 402 may withstand a separation force greater than one ton and a sheer force greater than seven-hundred pounds. Further still, in another embodiment the magnet 402 may have a separation force less than one ton and a sheer force of less than seven-hundred pounds. Accordingly, this disclosure contemplates utilizing magnets 402 that have any known separation and sheer force.

Further, multiple magnetic coupler assemblies 104 may be positioned along the form assembly 100 to ensure that the form assembly 100 does not move relative to the base 102 when the form substance is applied. Each magnetic coupler assembly 104 may selectively be magnetically coupled to the base 102 to ensure that the form assembly 100 remains oriented as desired. In one non-exclusive example, every other form element 106 of the form assembly 100 may have a magnetic coupler assembly 104. In another embodiment, every form element 106 may have a magnetic coupler assembly 104. In yet another embodiment, magnetic coupler assemblies 104 may be spaced greater than every other form element 106. Accordingly, this disclosure considers placing magnetic coupler assembly 104 along any advantageous location of a form assembly 100.

In one aspect of this disclosure, the magnetic coupler assembly 104 may be removably coupled to the form assembly 100 with one or more bolts 108. The bolts 108 may be threadably coupled to the magnetic coupler assembly 104 through a surface 208 of the form assembly 100 to thereby couple the magnetic coupler assembly 104 to the form assembly 100. Further, the bolts 108 may be positioned to orient the magnetic coupler assembly 104 so the magnet 402 faces the base 102 to allow the magnet 402 to be selectively coupled thereto as described herein. In one aspect of this disclosure, the magnetic coupler assembly 104 may have threaded through holes 209 defined therein to allow the bolts 108 to couple the magnetic assembly 104 to the form assembly 100. While bolts 108 are described herein for coupling the magnetic coupler assembly 104 to the form assembly 100, any known coupling method can be used and bolts are only one non-exclusive example.

Figure 2:
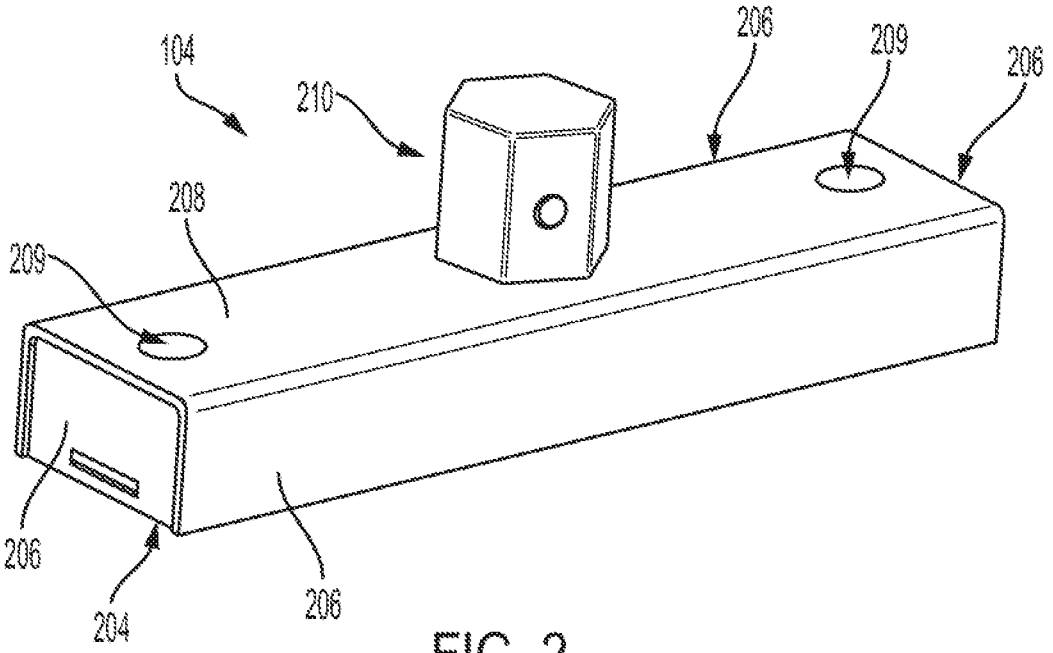
FIG. 2 is an elevated perspective view of a magnetic coupler assembly.

Referring now to FIG. 2, an isolated view of the magnetic coupler assembly 104 is illustrated. The magnetic coupler assembly 104 may be formed as part of the form assembly 100 or it may be an entirely separate component that is removably coupled to the form assembly 100 with the bolts 108 or the like. Regardless of how the magnetic coupler assembly 104 is coupled to, or formed with, the form assembly 100, the magnetic coupler assembly 104 may have a housing 202 that defines a coupler plane 204. The housing 202 may be formed of a plurality of walls 206 defined along a perimeter of the coupler assembly 104 and a top member 208. The walls 206 may be coupled to the top member 208 to at least partially define an inner cavity 410 in which the magnet 402 (see FIG. 4) is positioned.

The coupler plane 204 may be defined along the bottom edge of the inner cavity 410 opposite the top member 208. The coupler plane 204 may be the planar location of the coupler assembly 104 that is locate along the base 102 or other underlying surface when the coupler assembly 104 is properly placed thereon. In other words, the coupler plane 204 may be the plane at which the magnet 402 will become positioned adjacent to the base 102 when the coupler assembly 104 is in a coupled position (see FIG. 4 for the coupled position of the magnet 402).

The coupler assembly 104 may have a release assembly 210 positioned at least partially above the top member 208. The release assembly 210 may provide a plurality of components that allow the rotation of a portion of the release assembly 210 to move the position of the magnet 402 relative to the coupler plane 204. As will be described in more detail herein, the release assembly 210 may be partially rotated with a tool to transition the coupler assembly 104 between a magnetically coupled orientation (see FIG. 4) and a released orientation (see FIG. 5).

Figure 3:
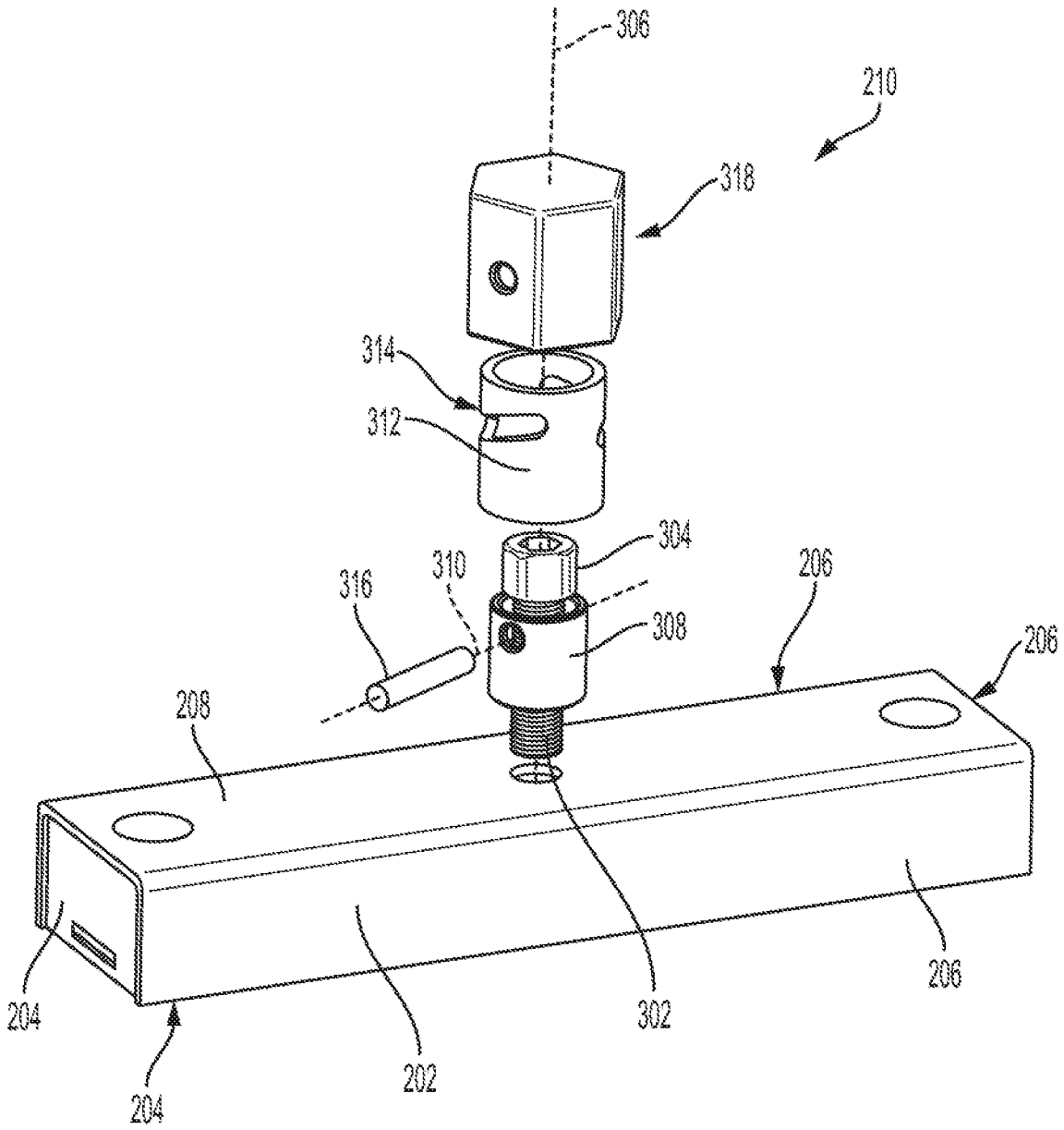
FIG. 3 is an exploded view of the magnetic coupler assembly of FIG. 2.

Referring now to FIG. 3, the release assembly 210 is illustrated in an exploded view to show the plurality of components therein. The release assembly 210 may have a magnet shaft 302 that extends through a hole in the top member 208 of the housing 202. The magnet shaft 302 may be coupled to the magnet 402 or a magnet carrier on one end, and define an expanded head 304 on the other end. The magnet shaft 302 may move axially along a rotation axis 306 to correspondingly move the magnet 402 between the magnetically coupled orientation and the released orientation.

In one aspect of this disclosure, a swivel cup bushing 308 may be positioned around the magnet shaft 302 and provide a recess 606 (see FIG. 6) that receives the expanded head 304. The swivel cup bushing 308 may define a through hole there through along a pin axis 310 that may be positioned adjacent to a top surface of the expanded head 304 when the expanded head 304 is properly positioned within the recess 606. The swivel cup bushing 308 may have an inner through hole sized to correspond with the expanded head 304 to allow the expanded head 304 to be positioned within the recess 606.

Figure 6:
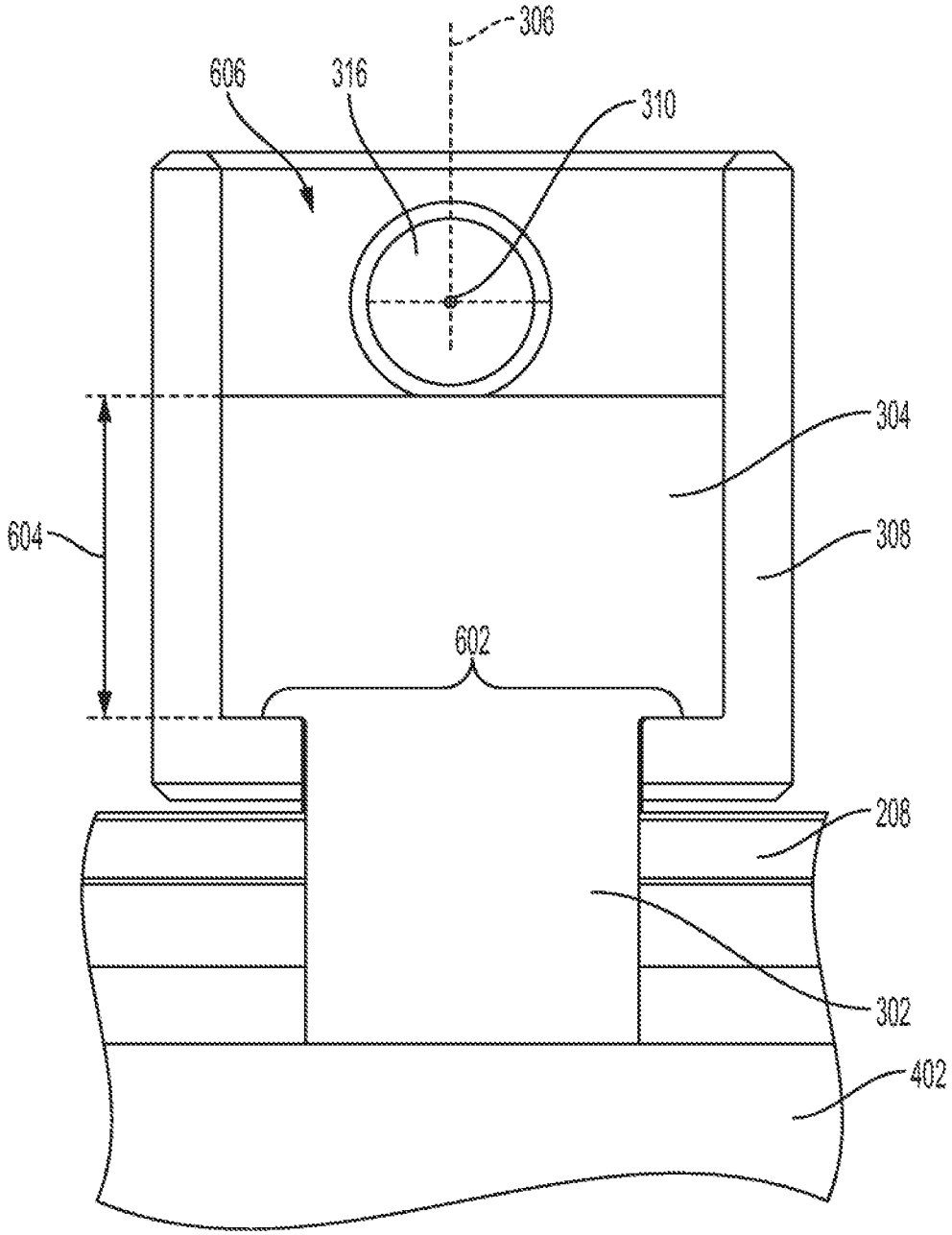
FIG. 6 is a sectional partial view of a release assembly of the magnetic coupler assembly of FIG. 2.

More specifically with reference to FIG. 6, a section view of the swivel cup bushing 308 with the expanded head 304 properly positioned therein is illustrated. The swivel cup bushing 308 may have a radial lip 602 on the end adjacent to the top member 208. The radial lip 602 may provide a through hole that is sized to allow the magnet shaft 302 to pass there through but to prevent the expanded head 304 from passing there through. In this configuration, when the expanded head 304 is properly placed within the recess 606 of the swivel cup bushing 308, axial movement of the swivel cup bushing 308 away from the top member 208 causes the expanded head 304 to contact the radial lip 602 to thereby move the magnet shaft 302 with the swivel cup bushing 308 axially along the rotation axis 306.

Alternatively, the through hole defined through the swivel cup bushing 308 along the pin axis 310 may be spaced at least a head thickness 604 from the radial lip 602. The head thickness 604 may be sized to be slightly greater than the axial thickness of the expanded head 304 along the rotation axis 306. In other words, the pin axis 310 through hole is positioned to allow the pin 316 to be positioned through the through hole of the pin axis 310 adjacent to the expanded head 304 when the expanded head 304 is properly positioned within the recess. Accordingly, when the pin 316 is positioned through the through holes of the swivel cup bushing 308 along the pin axis 310, the expanded head 304 and the magnet shaft 302 may be moved axially with the swivel cup bushing 308 through contact with either the radial lip 602 (when the swivel cup bushing is moving away from the top member 208) or the pin 316 (when the swivel cup bushing is moving towards the top member 208).

In one non-limiting example, when the swivel cup bushing 308 moves towards the top member 208, the pin 316 may contact a top portion of the expanded head 304 to cause the expanded head 304, magnet shaft 302, and magnet 402 to move axially in the same direction. Alternatively, when the swivel cup bushing 308 moves away from the top member 208, the radial lip 602 may contact a bottom portion of the expanded head 304 to cause the expanded head 304, magnet shaft 302, and magnet 402 to move axially in the same direction. Accordingly, when the expanded head 304 is properly positioned within the recess 606 of the swivel cup bushing 308 and the pin 316 is positioned through the holes along the pin axis 310, the expanded head 304, magnet shaft 302, and magnet 402 are caused to move axially along the rotation axis 306 with the swivel cup bushing 308.

Referring back to FIG. 3, the release assembly 210 may also have a cam collar 312 positioned therein. The cam collar 312 may be a substantially cylindrical component with a through hole defined there through. The cam collar 312 may be sized to fit around the swivel cup bushing 308. In one aspect of this disclosure, the cam collar 312 may be coupled to the top member 208 of the housing 202 to remain fixed relative thereto. In one non-exclusive example, the cam collar 312 and top member 208 may be formed of a metal and welded to one another. However, the cam collar 312 can be fixed to the top member 208 using any fastening method known in the art capable of fixing the cam collar 312 relative to the top member 208.

The cam collar 312 may also have one or more helix segment 314 defined there through. The helix segment 314 may be defined through the cylindrical sidewall of the cam collar 312 about the rotation axis 306. In one aspect of this disclosure, the helix segment 314 may transition axially away from the top member 208 as the helix segment 314 rotates in a counter-clockwise direction as viewed in FIG. 3. In other words, the helix segment 314 may be an arced slot in the wall of the cam collar 312 that is defined in an axially extending helical pattern.

In one aspect of this disclosure, a pin 316 may be positioned through the helix segment 314 of the cam collar 312. The pin 316 may further pass through the swivel cup bushing 308 above the expanded head 304. The pin 316 may be defined along the pin axis 310 which is defined through an intersection of the rotation axis 306 in a substantially perpendicular orientation respective thereto. The pin 316 may be rotationally fixed to the swivel cup bushing 308 wherein rotation of the pin 316 about the rotation axis 306 causes the swivel cup bushing 308 to rotate about the rotation axis 306 in substantially the same way. Further still, the pin 316 may be fixed to the swivel cup bushing 308 so that axial movement of the pin 316 along the rotation axis 306 also causes axial movement of the swivel cup bushing 308.

As discussed herein, the magnet shaft 302 is coupled to the magnet 402 on one end. Accordingly, axial movement of the magnet shaft 302 along the rotation axis 306 will also cause axial movement of the magnet 402. Further still, since the pin 316 is coupled to the swivel cup bushing 308, and the expanded head 304 is axially constrained in the recess 606 of the swivel cup bushing 308 when the pin 316 is positioned there through, axial movement of the pin 316 along the rotation axis 306 also causes axial movement of the magnet 402 via the pin's 316 coupling to the swivel cup bushing 308.

As described herein, the pin 316 is positioned through the helix segment 314 of the cam collar 312. Further, the pin 316 may extend at least partially into the helix segment 314 so a portion of the pin 316 remains within the helix segment 314. In one non-limiting example, the pin 316 may have a pin diameter that is slightly less than a helix segment width to allow the pin 316 to slide within the helix segment 314. In this configuration, the axial location of the pin 316 along the rotation axis 306 may be substantially controlled by the location of the pin 316 in the helix segment 314. In other words, the axial location of the pin 316, rotatable member 308, magnet shaft 302, and magnet 402 along the rotation axis 306 is controlled by the location of the pin 316 within the helix segment 314.

Figure 7:
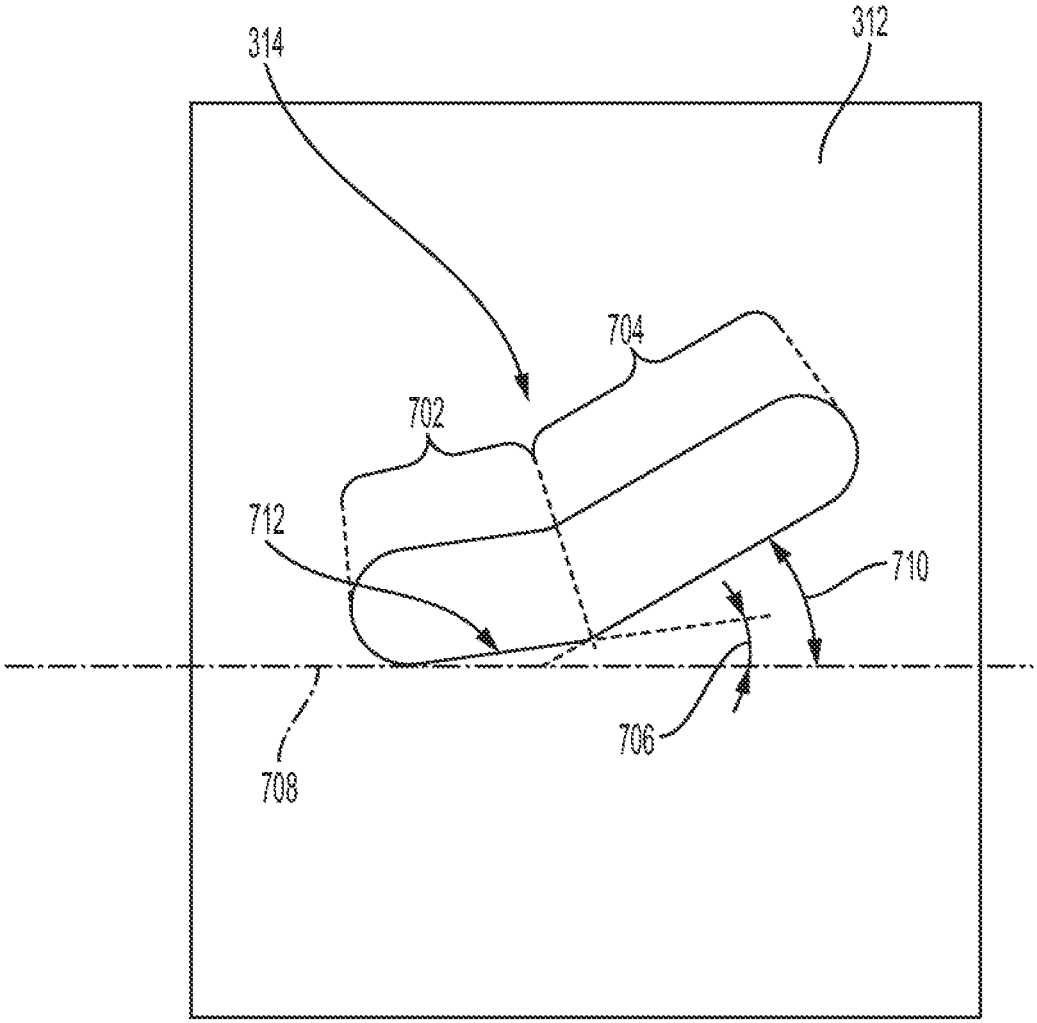
FIG. 7 is a side view of a helix segment from a cam collar of the release assembly of FIG. 6.

Referring now to FIG. 7, a side profile of the helix segment 314 is more clearly illustrated. More specifically, the helix segment 314 is illustrated as having a breakaway section 702 and a transition section 704. The breakaway section 702 may have a leading edge 712 that defines a breakaway angle 706 relative to a top plane 708 that is parallel to the top member 208. The breakaway section and angle 702, 706 may be specifically configured to provide an initial axial breakaway force to the magnet 402 when the swivel cup bushing 308 is rotated so the pin 316 travels along the breakaway section 702 towards the transition section 704.

In one non-exclusive example of this disclosure, the breakaway angle 706 may be about six degrees. However, in another example the breakaway angle 706 may be less than six degrees. Further still, in another example the breakaway angle may be greater than six degrees. Accordingly, the breakaway angle 706 may be any angle that is appropriate to provide a breakaway force to the magnet 402 as described herein.

In one aspect of this disclosure, the transition section 704 may have a transition angle 710 that is greater than the breakaway angle 706. The transition angle 710 may be steeper or greater than the breakaway angle 706 because the magnet 402 may be spaced from the base 102 or the like surface when the pin 316 is along the transition section 704. That is to say, the magnet 402 may already have broken away from the underlying ferromagnetic material and the force required to continue to transition the pin 316 along the transition section 704 of the helix segment 314 may be less than the breakaway force required at the breakaway section 702.

While the leading edge 712 is depicted in FIG. 7 as being substantially planar along the breakaway section 702 and the transition section 704, the leading edge 712 may be arc-shaped along the helix segment 314 between the breakaway section 702 and the transition section 704. Further still, the breakaway section 702 and transition section 704 may be a single arc that become steeper relative to the top plane 708 as the helix segment 314 approaches the second position 504. Further still, the leading edge 712 may be substantially planar along both the breakaway section and the transition section 704 and have the same breakaway angle 706 and transition angle 710.

Referring back to FIG. 3 the release assembly 210 may also have a hex cap 318 positioned around the cam collar 312. Further, the hex cap 318 may be coupled to the pin 316 to thereby be rotationally coupled to the swivel cup bushing 308. In other words, the pin 316 extends from a portion of the hex cap 318, through the helix segment 314 of the cam collar 312, through the swivel cup bushing 308, and above the expanded head 304 of the magnet shaft 302. Accordingly, as the hex cap 318 rotates, the pin 316 is moved along the helix segment 314 to thereby axially displace the magnet shaft 302 and magnet 402 along the rotation axis 306.

The hex cap 318 is shown and described herein as being hexagonal in cross-section. However, this disclosure considers any cross-sectional shape for the hex cap 318. More specifically, in one non-exclusive example the hex cap 318 is hexagonally shaped so that a common tool can be used to rotate the hex cap 318. However, other shapes are also considered wherein a tool can be used to apply a rotational torque to the hex cap 318. Accordingly, this disclosure considers forming the hex cap 318 in many different shapes and the hexagonal shape is meant only as one non-exclusive example.

Figure 4:
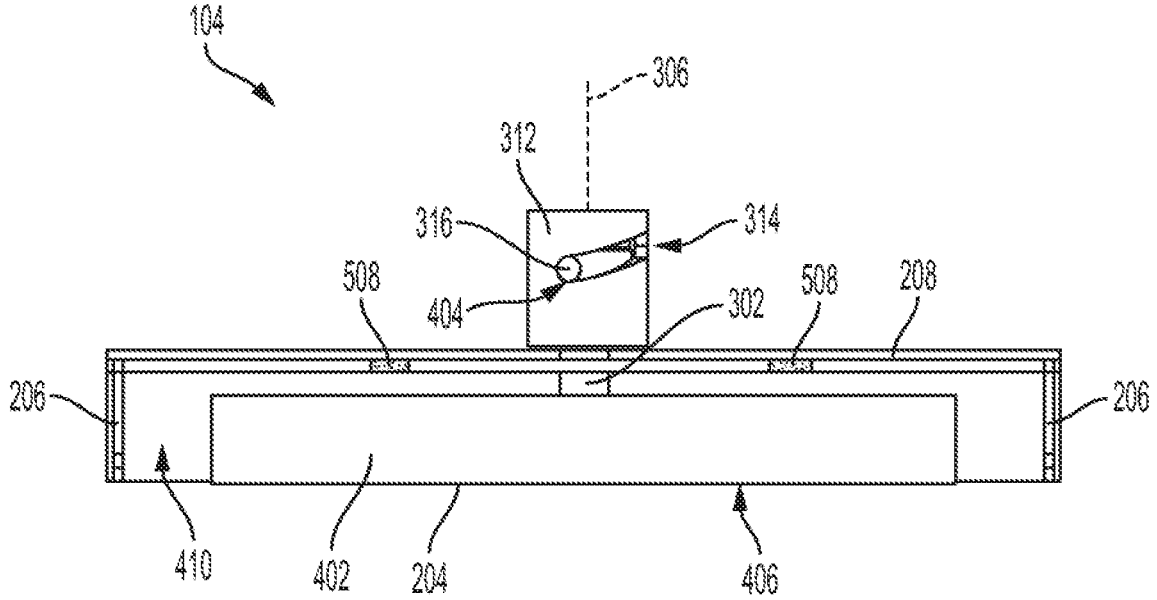
FIG. 4 is a partial section side view of the magnetic coupler assembly of FIG. 2 in an adjacent position with a hex cap removed.
Figure 5:
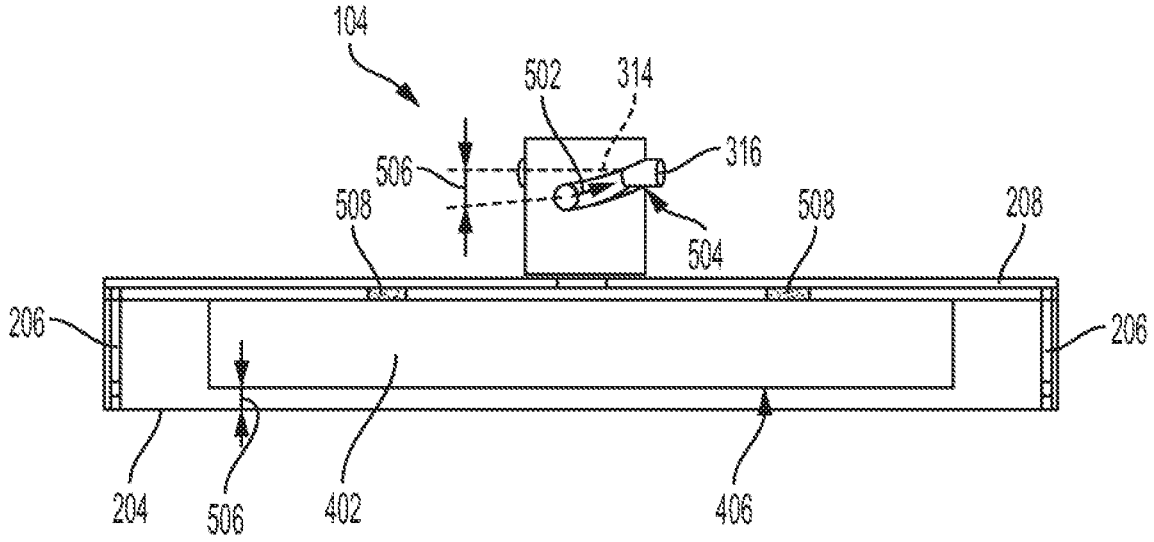
FIG. 5 is a partial section side view of FIG. 4 in a spaced position.

Referring now to FIGS. 4 and 5, a partial section side view of the magnetic coupler assembly 104 is illustrated with the hex cap 318 removed. The magnet 402 is in the adjacent position in FIG. 4 and in the spaced position in FIG. 5. In FIG. 4, the pin 316 is located in a first position 404 of the helix segment 314 along the breakaway section 702. When the pin 316 is in the first position 404, the pin 316 may be in the portion of the helix segment 314 that is axially closest to the top member 208 of the housing 202. Accordingly, when the pin 316 is in the first position 404, the magnet 402 may be in the adjacent position wherein an outer surface 406 of the magnet 402 is located adjacent to the coupler plane 204 of the housing 202. In this orientation, the magnet 402 will apply a magnetic force to any ferromagnetic materials positioned along the coupler plane 204 to magnetically couple the magnetic coupler assembly 104 thereto.

In FIG. 5, the pin 316 has been rotated in a release direction 502 to become positioned in a second position 504 of the helix segment 314 in the transition section 704. The second position 504 may be axially offset along the rotation axis 306 an axial offset 506 relative to the first position 404. Accordingly, as the pin 316 transitions from the first position 404 of the helix segment 314 to the second position 504, the pin 316, swivel cup bushing 308, expanded head 304, magnet shaft 302, and magnet 402 are correspondingly axially offset along the rotation axis 306.

In one aspect of this disclosure, when the pin 316 is in the second position 504 of the helix segment 314, the magnet 402 is moved the axial offset 506 from the coupler plane 204. By spacing the outer surface 406 of the magnet 402 the axial offset 506 from the coupler plane 204, the magnetic force of the magnet 402 may be insufficient to substantially magnetically couple the magnetic coupler assembly 104 to ferromagnetic material along the coupler plane 204. In other words, moving the magnet 402 the axial offset 506 from the coupler plane 204 may uncouple the magnetic coupler assembly 104 from an adjacent surface.

In another aspect of this disclosure, when the magnet is in the spaced position of FIG. 5, magnet spacers 508 may be positioned between the magnet 402 and the top member 208. The magnet spacers 508 may be made of a ferromagnetic material to partially magnetically couple the magnet 402 thereto when the magnet is in the spaced position. The magnet spacers 508 may be strips of ferromagnetic material that do not cover the entire upper surface of the magnet 402 between the magnet 402 and the top member 208. By only partially covering the upper surface of the magnet 402, the separation force required to transition the magnet from the spaced positioned away from the magnet spacers 508 to the adjacent position may be substantially less than the breakaway force required to uncouple the magnet 402 from the base 102 when the magnet is in the adjacent position.

In other words, the magnet spacers 508 may be dimensioned to magnetically couple the magnet 402 thereto to retain the magnet in the spaced position but only require a minimum separation force to transition the magnet 402 to the adjacent position. In the non-exclusive exclusive example mentioned herein where the breakaway force is one ton, the separation force required between the magnet 402 and the magnet spacers 508 may be less than one ton. Further still, in one non-exclusive embodiment the separation force may be less than eight-hundred pounds. In yet another embodiment, the separation force may be less than five-hundred pounds. Further still, the required separation force may be less than one-hundred hundred pounds. The separation force required to separate the magnet 402 from the magnet spacers 508 depends on the number and dimensions of the magnet spacer 508. Accordingly, this disclosure considers sizing the magnet spacers 508 to accommodate any desired separation force.

As described above, the hex cap 318 is coupled to the pin 316 in the embodiment shown. Rotating the hex cap 318 may transition the pin 316 between the first and second position 404, 504 of the helix segment 314. Accordingly, rotating the hex cap 318 transitions the magnet 402 the axial offset 506 between the adjacent position of FIG. 4 and the spaced position of FIG. 5.

In one aspect of this disclosure, the coupler housing 202 may define the inner cavity 410 to provide structural support for separating the magnet 402 from an underlying ferromagnetic material. In other words, as the hex cap 318 is rotated from the magnetically coupled position to the released position, the magnet shaft 302 pulls the magnet 402 away from the coupler plane 204. Further, since the cam collar 312 is coupled to the top member 208, the separation force created when the hex cap 318 is rotated is distributed to the side walls 206 to thereby distribute the separation force to the base 102 until the magnet 402 is moved the axial offset 506 away from the coupler plane 204.

In one aspect of this disclosure, the helix segment 314 may be two helix segments that are substantially 180 degrees offset from one another about the rotation axis 306. In this configuration, the pin 316 may extend substantially all of the way through a center cross-section of the cam collar 312 and swivel cup bushing 308. Further, the pin 316 may extend from one side of the hex cap 318 to substantially the opposite side thereof.

While a swivel cup bushing 308 is described and illustrated herein, one embodiment may not have a swivel cup component at all. Rather, in one embodiment the magnet shaft 302 may be positioned adjacent to the cam collar 312 without positioning a swivel cup bushing there between. More specifically, in one aspect of this disclosure, the expanded head 304 may be positioned in a recess of the magnet 402 and the magnet shaft 302 may extend through the top member 208 and into the cam collar 312. The expanded head 304 may be positioned within the magnet 402 so it can rotate therein while maintaining the axial location of the magnet 402 along the rotation axis 306. In other words, the magnet shaft 302 may pass through a through hole of the magnet 402 towards the release assembly 210 and the expanded head 304 may be too large to pass there through.

In this embodiment, the pin 316 may be positioned through the helix segment 314 of the cam collar 312 and through a corresponding through hole defined in the magnet shaft 302, without having a swivel cup bushing defined there between. In this configuration, the expanded head 304 in the magnet 402 may rotate as the pin 316 rotates the magnet shaft 302 while the pin 316 moves within the helix segment 314. As the pin 316 moves along the helix segment 314, it may axially move the magnet shaft 302 and magnet 402 therewith.

In embodiments with a swivel cup bushing 308, the swivel cup bushing 308 may be formed from a material that acts as a bushing to limit the frictional rotation resistance between the swivel cup bushing 308 and the cam collar 312 and between the swivel cup bushing 308 and the expanded head 304.

In one aspect of this disclosure, when the pin 316 is in the first position 404 of the helix segment 314 the hex cap 318 may be in a first angular orientation relative to the housing 202. Similarly, when the pin 316 is in the second position 504 of the helix segment 314, the hex cap 318 may be in a second angular orientation relative to the housing 202. Accordingly, the hex cap 318 may be rotatable between the first angular orientation and the second angular orientation. In one non-exclusive example, the rotation angle about the rotation axis 307 between the first angular orientation and the second angular orientation may be about ninety degrees. In another example, the rotation angle may be about one-hundred and twenty degrees. In yet another example, the rotation angle may be about one-hundred and eighty degrees. Further sill, the rotation angle may also be less than about ninety degrees or greater than one-hundred and eighty degrees.

In practice, a user may have a plurality of form elements 106 that they desire to utilize for a form assembly 100. The user will couple the form elements 106 together to form the desired outer surface form. Then, the user may position the form assembly 100 on a ferromagnetic base 102 in a particular orientation desired by the user. Next, the user may rotate the hex cap 318 to the first angular orientation to thereby allow the magnetic coupler assembly 104 to be in the adjacent position of FIG. 4. In the adjacent position, the magnet 402 may be magnetically coupled to the base 102 to substantially maintain the form assembly in the orientation desired by the user. The user may then pour a form substance within the form. The form assembly 100 remains magnetically coupled to the base 102 with the magnetic coupler assembly 104 while the form substance cures.

After the form substance cures, or at any other time desired by the user, the magnetic coupler assembly 104 may be released from the base 102 to thereby allow the form assembly 100 to be removed therefrom. To release the magnetic coupler assembly 104 from the base 102, the user may use a suitably sized wrench or the like to rotate the hex cap 318 from the first angular orientation to the second angular orientation. As the hex cap 318 is rotated to the second angular orientation, the magnet 402 is pulled away from the surface of the base 102 as the pin 316 moves axially away from the top member 208 as it slides within the helix segment 314 to the second position 504. Initially, the pin 316 will apply the breakaway force to the magnet as the pin 316 travels along the breakaway section 702. Once the pin is in the second position 504 and the magnet 402 is spaced the axial offset 506 from the base 102, the form assembly 100 will no longer be substantially magnetically coupled to the base 102 and the form assembly 100 may be removed. Further still, the magnet 402 may be partially magnetically coupled to the magnet spacers 508 when the pin is in the second position 504, the partial magnetic coupling being sufficient to maintain the magnet 402 in the spaced position until the hex cap 318 is rotated to transition the pin 316 towards the first position 404.

In other words, when the pin is in the first position 404, the hex cap 318 is in the first angular position and the magnet is in the adjacent position of FIG. 4. As the hex cap 318 is rotated in the counter-clockwise direction (from the perspective of FIG. 3) about the rotation axis 306 toward the second angular position, the pin 316 travels along the leading edge 712 of the breakaway section 702 to apply a breakaway force, which is transmitted to the magnet 402 to move the magnet 402 away from the underlying ferromagnetic material. Once the magnet 402 has been at least partially separated from the underlying ferromagnetic material, the pin 316 may continue to travel along the transition section 704 of the helix segment 314 to move the magnet towards the magnet spacer 508 and away from the coupler plane 204. Once the hex cap 316 is rotated to the second angular position, the pin 316 may be in the second position 504 of the helix segment 314 and the magnet 402 may be partially magnetically coupled to the magnet spacer 508. The partial magnetic coupling between the magnet 402 and the magnet spacers 508 may be sufficient to maintain the magnet 402 in the spaced position until the hex cap 318 is rotated in the clockwise direction as described herein.

The magnet 402 may remain partially magnetically coupled to the magnet spacers 508 and in the spaced position until the hex cap 318 is rotated in the clockwise direction (from the perspective of FIG. 3) about the rotation axis 305 from the second angular position towards the first angular position. Initially, as the hex cap 316 is rotated in the clockwise direction, the pin 316 travels along the transition section 704 of the helix segment 314 to apply an axial force on the magnet 402 away from the magnet spacers 508. Once the magnet 402 is spaced from magnet spacer 508, it will continue to travel towards the coupler plane 204 until the pin 316 is in the first position 404. At that point, the magnet 402 may be magnetically coupled to any ferromagnetic material positioned along the coupler plane 204 such as a base 102 or the like. The magnet 402 may remain coupled to the ferromagnetic material until the hex cap 318 is rotated in the counter-clockwise position as discussed herein.

In one aspect of this disclosure, as the swivel cup bushing 308 moves corresponding with the pin 316 as it moves out of the first position 404, the radial lip 602 of the swivel cup bushing 308 applies both an axial force and a torsional force to the expanded head 304. More specifically, since the swivel cup bushing 308 is rotating as it moves axially along the helix segment 314, a torsional force may also be applied to the expanded head 304 as the pin 316 transitions from the first position 404 to the second position 504.

In one non-exclusive example, the expanded head 304 may be the head to a bolt and the magnet shaft 302 may be a threaded body of the bolt. In this configuration, the rotary motion of the swivel cup bushing 308 may urge the bolt to become loosened from the magnet 402. Accordingly, one embodiment of this disclosure may include a friction reducing material between the expanded head 304 and the radial lip 602 to thereby reduce the rotational forces applied to the expanded head 304 when the swivel cup bushing 308 is rotated. The friction reducing material may be a bushing made of a low friction material. Further, the friction reducing material may be a grease or other friction reducing substance that can be applied to the radial lip 602. Further still, in one embodiment of this disclosure the threaded body of the magnet shaft 302 may be threaded in a reverse pattern wherein rotating the hex cap 318 from the first angular position to the second angular position causes a torsional force to the expanded head 304 in the tightening direction.

The term "magnet" as used throughout when referring to the magnet 402 may be a unitary magnetic material or may be a magnet assembly or combination of magnets. In one embodiment, the magnet 402 includes a magnet carrier and at least two magnets retained by the carrier. In this embodiment, the magnets shaft 302 may be coupled to the magnet carrier and not directly to a permanent magnet. In one embodiment, the magnets may be positioned within the carrier and aligned to provide a maximum magnetic force towards the coupler plane 204 as is known in the art. Accordingly, this disclosure considers utilizing any known magnet or magnetic assembly capable of exerting a magnetic force.

The magnetic coupling often utilizes a magnet circuit to provide the needed holding force to securely support the weight and structure of the form and the concrete positioned therein. Further, the magnet circuit often includes magnets interleaved between steel or other ferrous metal strips. The metal strips can have a similar size as the magnets but extend below the magnets to provide gaps below the magnets and between the metal strips. Often, to enhance the magnetic circuit, the magnets are oriented so that a first magnet is oriented in a North-South pole orientation, whereas an adjacent, second magnet is oriented in a South-North orientation. This North-South/South-North orientation scheme is carried through with the remainder of the magnets. This North-South and South-North alternating orientation arrangement is repeated for the various magnets along the length of the magnet assemblies. Through this arrangement, a strong magnetic circuit is achieved that helps to magnetically couple the magnets to adjacent ferrous materials.

While an exemplary embodiment incorporating the principles of the present application has been disclosed hereinabove, the present application is not limited to the disclosed embodiments. Instead, this application is intended to cover any variations, uses, or adaptations of the application using its general principles. Further, this application is intended to cover such departures from the present disclosure as come within known or customary practice in the art to which this present application pertains and which fall within the limits of the appended claims.

The terminology used herein is for the purpose of describing particular illustrative embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations).

What is claimed is:

1. A magnetic coupler, comprising:

a housing defining a coupler plane;

a magnet assembly positioned at least partially within the housing, the magnet assembly being movable relative to the coupler plane;

a release assembly coupled to the magnet assembly to selectively reposition the magnet assembly relative to the coupler plane based on the angular orientation of the release assembly, wherein the release assembly comprises a bushing that is rotatable about a rotation axis relative to the housing;

a cam collar coupled to the housing about the rotation axis, the cam collar defining a helix segment; and a magnet shaft positioned along the rotation axis and coupled to the magnet assembly on one end and extending through a portion of the housing, the magnet shaft further defining a radially expanded head;

wherein the radially expanded head is positioned at least partiality within the bushing.

2. The magnetic coupler of claim 1, further comprising a pin coupled to the bushing and positioned along the helix segment of the cam collar, wherein rotating the bushing causes the pin to move along the helix segment to thereby reposition the location of the magnet assembly relative to the coupler plane.

3. The magnetic coupler of claim 2, further comprising a hex cap positioned at least partially around the bushing and the cam collar, the hex cap being coupled to the pin, wherein rotation of the hex cap also rotates the bushing with the pin.

4. The magnetic coupler of claim 3, further wherein the hex cap has a first angular position and a second angular position, wherein in the first angular position the pin is located along a portion of the helix segment to position the magnet assembly adjacent to the coupler plane and in the second angular position the pin is locate along a portion of the helix segment to position the magnet assembly away from the coupler plane.

5. A magnetic coupler assembly, comprising:

a housing defining a coupler plane;

a magnet assembly positioned at least partially within the housing, the magnet assembly being movable relative to the coupler plane; and a release assembly comprising:

a bushing that is rotatable about a rotation axis relative to the housing, the bushing defining a radial lip;

a cam collar coupled to the housing about the rotation axis, the cam collar defining a helix segment;

a magnet shaft defined along the rotation axis and coupled to the magnet assembly on one end and extending through a portion of the housing and defining an expanded head on the other end; and a pin coupled to the bushing and positioned along the helix segment of the cam collar;

wherein the radial lip of the bushing is positioned at least partially between the expanded head of the magnet shaft and the housing and rotating the pin about the rotation axis repositions the bushing, magnet shaft, and magnet axially along the rotation axis relative to the coupler plane between an adjacent position and a spaced position.

6. The magnetic coupler of claim 5, further comprising a hex cap positioned at least partially around the bushing and the cam collar, the hex cap being coupled to the pin, wherein rotation of the hex cap also rotates the bushing with the pin.

7. The magnetic coupler of claim 6, further wherein the hex cap has a first angular position and a second angular position, wherein in the first angular position the pin is located along a breakaway section of the helix segment to position the magnet assembly in the adjacent position relative to the coupler plane and in the second angular position the pin is locate along transition section of the helix segment to position the magnet assembly in the spaced position relative to the coupler plane.

8. The magnetic coupler of claim 5, further wherein the housing is coupled to a form wall.

9. The magnetic coupler of claim 5, further wherein the magnet assembly has a permanent magnet.

10. The magnetic coupler of claim 5, further wherein in the spaced position the magnet assembly is sufficiently spaced from the coupler plane within the housing so any magnetic force of the magnet assembly does not substantially attract ferromagnetic material positioned along the coupler plane.

11. The magnetic coupler or claim 5, further wherein in the spaced position the magnetic coupler is not substantially magnetically coupled to a ferromagnetic material along the coupler plane and in the adjacent position the magnetic coupler is magnetically coupled to ferromagnetic material along the coupler plane.

12. The magnetic coupler of claim 5, further wherein the housing defines a cavity with an opening along the coupler plane, wherein in the spaced position the magnet assembly moves away from the coupler plane into the cavity.

13. The magnetic coupler of claim 7, further wherein the breakaway section is defined at a first angle relative to the coupler plane and the transition section is defined a second angle relative to the coupler plane, the first angle being different from the second angle.

14. The magnetic coupler of claim 13, further wherein the first angle is less than the second angle.

15. A system for coupling a form to a base, comprising:

a form element; and a magnetic coupler assembly coupled to the form element, the magnetic coupler assembly, comprising:

a housing defining a coupler plane;

a magnet assembly positioned at least partially within the housing, the magnet assembly being movable relative to the coupler plane; and a release assembly comprising:

a bushing that is rotatable about a rotation axis relative to the housing, the bushing defining a radial lip;

a cam collar coupled to the housing about the rotation axis, the cam collar defining a helix segment;

a magnet shaft defined along the rotation axis and coupled to the magnet assembly on one end and extending through a portion of the housing and defining an expanded head on the other end; and a pin coupled to the bushing and positioned along the helix segment of the cam collar;

wherein the radial lip of the bushing is positioned at least partially between the expanded head of the magnet shaft and the housing and rotating the pin about the rotation axis reposition the bushing, magnet shaft, and magnet axially along the rotation axis relative to the coupler plane between an adjacent position and a spaced position.

16. The system of claim 15, further wherein when the magnet is in the adjacent position, the form wall is magnetically coupled to an underlying form table to substantially restrict the form wall from moving and when the magnet assembly is in the spaced position the form wall is not substantially magnetically coupled to the underlying form table and the form wall may be moved relative to the form table.

* * * * *